US006058552A

United States Patent [19]

Hanan

[11] Patent Number: 6,058,552

[45] Date of Patent: May 9, 2000

[54] MOP HAVING HOLD DOWN BARS FOR REMOVABLY SECURING AN ABSORBENT PIECE OF MATERIAL THERETO

[76] Inventor: Abraham Hanan, 400 Central Park W., New York, N.Y. 10024

[21] Appl. No.: 08/872,410

[22] Filed: Jun. 10, 1997

[51] Int. Cl.[7] ..... A47L 13/46

[52] U.S. Cl. ..... 15/228; 15/231

[58] Field of Search ..... 15/150, 228, 147.1, 15/231, 232

[56] References Cited

U.S. PATENT DOCUMENTS

| | | | |
|---|---|---|---|
| 697,470 | 4/1902 | Gatch | 15/231 |
| 734,954 | 7/1903 | Reissmann | 15/231 |
| 1,714,350 | 5/1929 | De Jong | 15/231 |
| 2,201,645 | 5/1940 | Epner | 15/231 |
| 4,225,998 | 10/1980 | Thielen | 15/231 |
| 4,516,360 | 5/1985 | Gringer | 15/231 |
| 4,971,471 | 11/1990 | Sloan | 15/228 |

FOREIGN PATENT DOCUMENTS

| | | | |
|---|---|---|---|
| 468908 | 10/1950 | Canada | 15/231 |
| 280117 | 4/1952 | Switzerland | 15/231 |

*Primary Examiner*—Randall E. Chin
*Attorney, Agent, or Firm*—Burgess, Ryan & Wayne

[57] ABSTRACT

A mop includes a handle; and a mop head secured to the lower end of the handle, the mop head including a main body of a generally rectangular parallelepiped configuration and having a lower surface, extensions formed at opposite sides of the main body to form first and second shoulders, each extension having a lower surface which is parallel and coplanar with the lower surface of the main body, a foam pad secured to a lower surface of the main body, first and second U-shaped hold down bars pivotally arranged on the main body, the hold down bars releasably engaging and holding down a piece of material which is wrapped about the foam pad by engaging ends of the piece of material on the first and second shoulders, and a releasable lock down assembly which releasably holds the first and second hold down bars on the first and second shoulders, respectively, the lock down assembly including protrusions extending from the main body to secure the hold down bars to the main body and to releasably lock the hold down bars on the shoulders.

6 Claims, 3 Drawing Sheets

MOP HAVING HOLD DOWN BARS FOR REMOVABLY SECURING AN ABSORBENT PIECE OF MATERIAL THERETO

BACKGROUND OF THE INVENTION

The present invention relates generally to mops, and more particularly, is directed to a mop having hold down bars for removably securing a piece of absorbent material thereto.

There are various types of conventional mops. One type of conventional mop includes a plurality of absorbent cloth strands of material secured to the mop head. As the mop is dragged across a spill or the like, the cloth strands absorb the liquid. However, in order to clean the mop, it is necessary to rinse the mop head and then wring out the cloth strands. Further, such mop is used only for cleaning up spills, and not for dusting and sweeping.

Another type of mop includes a foam pad which is also used for cleaning up spills. In order to clean the mop, a pivotable metal member is provided on the mop head for pressing against the foam pad in order to wring out liquid therefrom. However, again, such mop head cannot be used for dusting and sweeping. In addition, cleaning of the mop head becomes rather cumbersome.

OBJECTS AND SUMMARY OF THE INVENTION

Accordingly, it is an object of the present invention to provide a mop that overcomes the aforementioned disadvantages.

It is another object of the present invention to provide a mop which can be used for cleaning up spills, while also being used for dusting and sweeping.

It is still another object of the present invention to provide a mop that can be easily and readily cleaned.

In accordance with an aspect of the present invention, a mop includes a handle; and a mop head secured to one end of the handle, the mop head including a main body having a lower surface and first and second shoulders on opposite sides of the mop head, a foam pad secured to a lower surface of the main body, first and second hold down bars movably arranged on the main body, the hold down bars releasably engaging and holding down a piece of material which is wrapped about the foam pad by engaging ends of the piece of material on the first and second shoulders, and a releasable lock down assembly which releasably holds the first and second hold down bars on the first and second shoulders, respectively.

Preferably, the main body has a generally rectangular parallelepiped configuration, and the mop head further includes extensions secured to opposite sides of the main body to form the first and second shoulders. The extensions are integrally formed with the main body. Protrusions extend outwardly from said main body and form the releasable lock down assembly, and the first and second hold down bars are releasably engaged on the first and second shoulders by the protrusions. Each extension has a lower surface which is parallel and coplanar with the lower surface of the main body.

The first and second hold down bars are pivotally connected to the main body between a raised position at which the piece of material is not held down thereby, and a lower locking position at which the ends of the piece of material are held down on the first and second shoulders. In such case, the releasable lock down assembly includes at least one projection extending outwardly from the main body which releasably holds the first and second hold down bars on the first and second shoulders, respectively.

Each hold down bar has a U-shape with opposite ends having inturned portions, and the main body includes opposite ends with holes for receiving the inturned portions so as to pivotally secure the first and second hold down bars to the main body.

A handle securing assembly pivotally mounts a lower end of the handle to the main body. The handle securing assembly includes two plates extending upwardly from an upper surface of the main body and receives the lower end of the handle therein, and a bolt extends through the plates and the lower end of the handle so as to pivotally secure the lower end of the handle to the main body.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
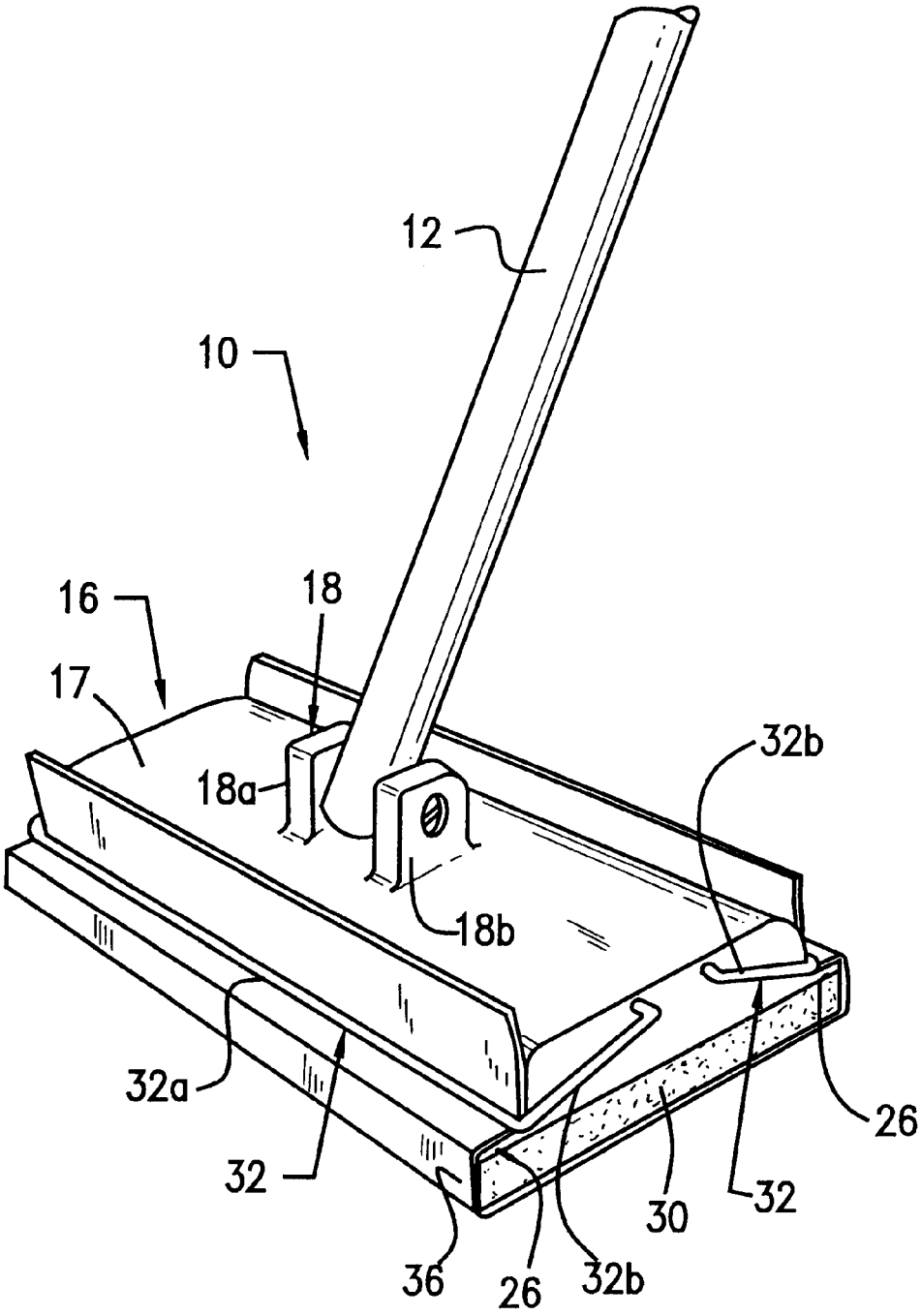
FIG. 1 is a perspective view of the mop according to the present invention, with an absorbent piece of material thereon.
Figure 2:
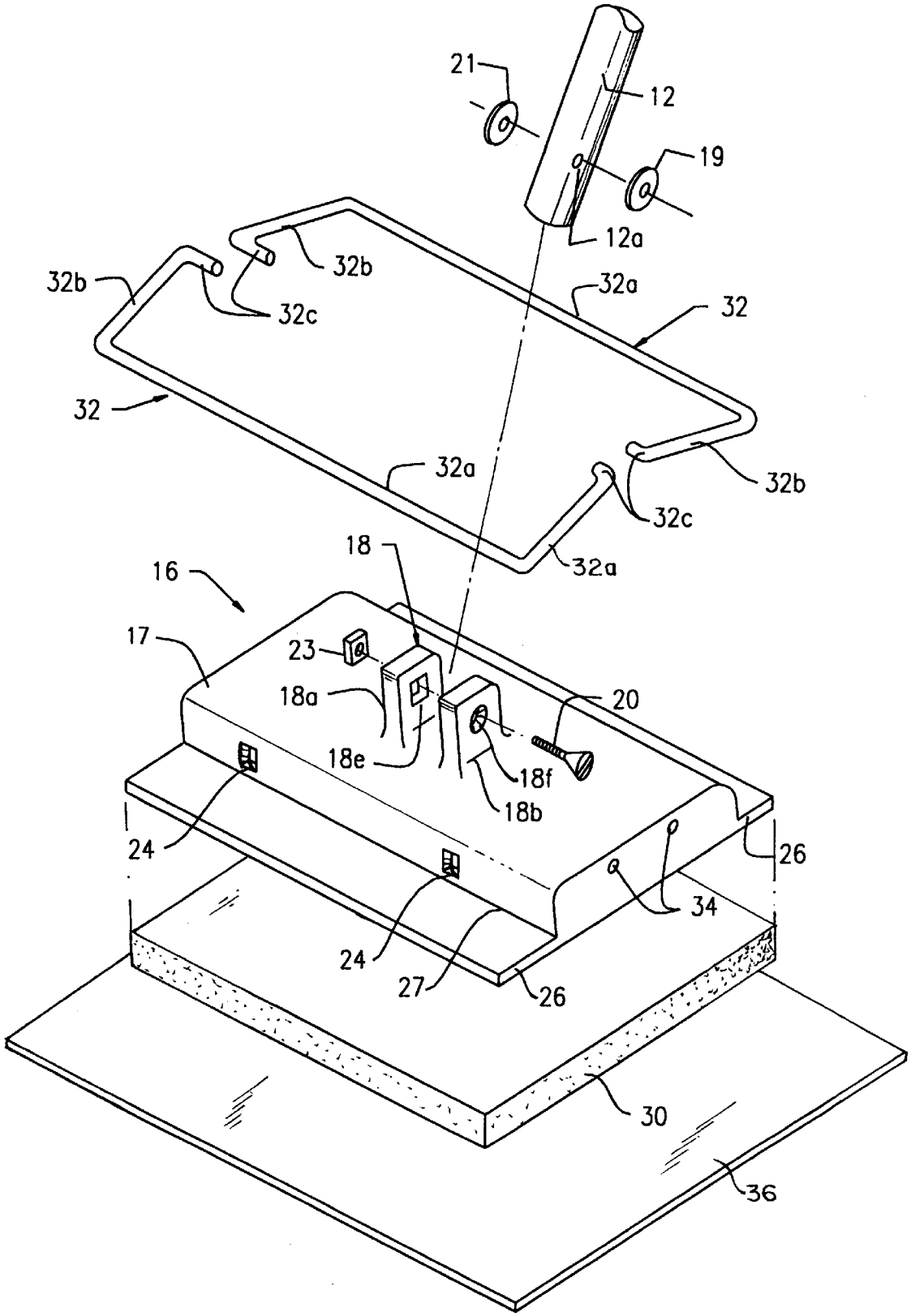
FIG. 2 is an exploded perspective view of the mop head of FIG. 2.

Referring to the drawings in detail, a mop 10 includes an elongated handle 12 which can be made of metal, plastic or wood.

Figure 4:
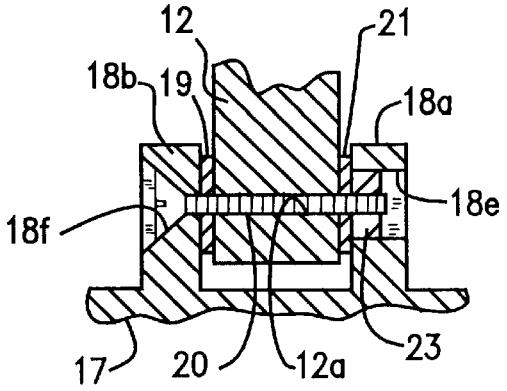
FIG. 4 is a cross-sectional view showing the arrangement for securing the handle to the mop head.

Mop 10 further includes a mop head 16 comprising a main body 17 having a generally rectangular parallelepiped configuration and which can be made of any suitable material, such as metal, plastic or wood. A handle connecting assembly 18 is integrally formed centrally at the upper surface of main body 17 of mop head 16 and is formed by two parallel, upstanding plates 18*a* and 18*b*. In this regard, the lower end of handle 12 fits between plates 18*b* and 18*b* of handle connecting assembly 18, and a bolt 20 extends through holes 18*e* and 18*f* in plates 18*a* and 18*b*, respectively, and through a hole 12*a* in the lower end of handle 12 to pivotally secure the lower end of handle 12 with respect to mop head 16. Bolt 20 is secured at the opposite side by a washer 21 and nut 23. As shown in FIG. 4, hole 18*f* in plate 18*b* is recessed for recessing the head of bolt 20. In addition, a second washer 19 can be positioned between plate 18*b* and the lower end 12*a* of handle 12.

Plate like extensions 26 are integrally formed with and extend from opposite sides of main body 17, with each extension 26 extending for the entire length of main body 17. Extensions 26 are of a lesser height than main body 17, and the lower edges of extensions 26 are substantially coplanar with the lower surface of main body 17. As a result, extensions 26 define first and second shoulders 27 on opposite sides of mop head 16.

Preferably, a foam pad 30 is secured along the entire lower surface of main body 17 and along the lower surfaces of extensions 26, that is, along the entire lower surface of mop head 16.

Two U-shaped hold down bars 32 are provided on opposite sides of mop head 16. Specifically, each hold down bar 32 includes a central hold down leg 32*a* and two opposite pivoting legs 32*b*, each having a free end with an inturned portion 32*c*. Inturned portions 32*c* are engaged within holes 34 at opposite ends of main body 17 so as to be pivotable between a raised position and a lower lock down position at the corner of a respective extension 26 with main body 17.

Figure 3:
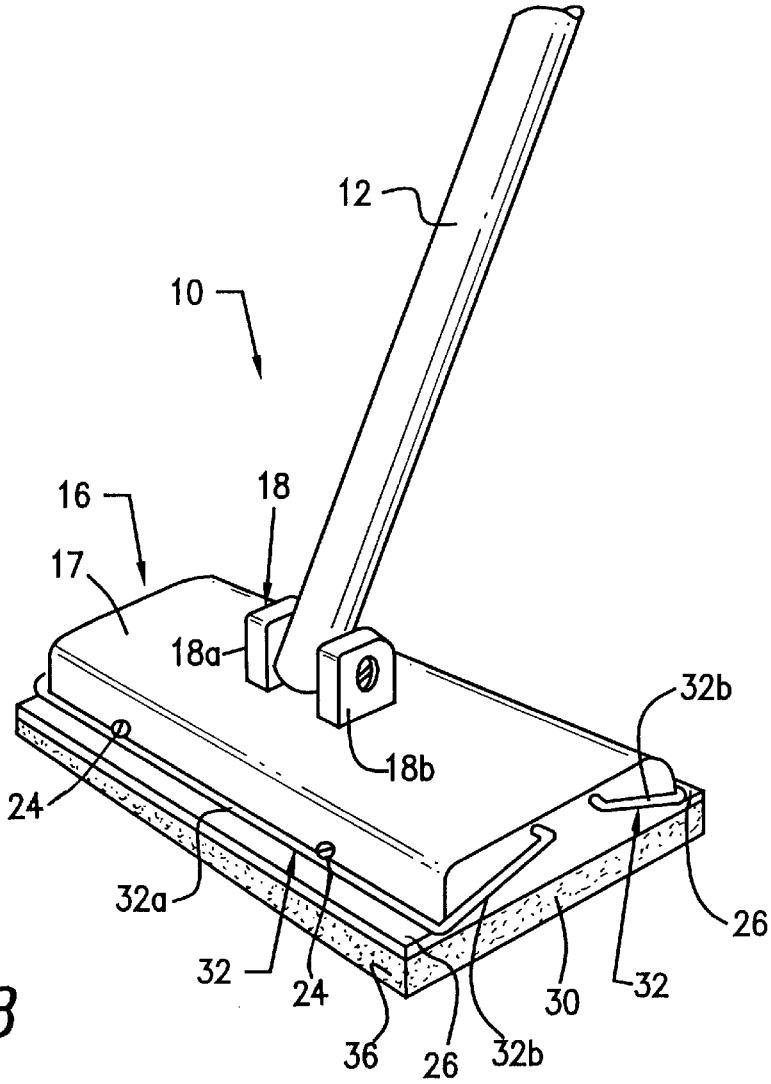
FIG. 3 is a perspective view of the mop according to the present invention, without the absorbent piece of material thereon.

As shown in FIGS. 1 and 3, when a hold down bar 32 is pivoted downwardly, hold down leg 32*a* thereof initially abuts the two small protrusions 24 on the respective side. Upon continued pushing, there is a slight deformation of the hold down bar 32 so that it rides over protrusions 24, and upon reaching the opposite side, returns to its unbiased position where it seats at the corner of the shoulder 27 of the respective extension 26, beneath the protrusions 24, so as to be releasably locked down thereby.

In accordance with the present invention, an absorbent piece of material 36 such as a disposable paper towel, a reusable cloth or a reusable rag, is wrapped about the underside of foam pad 30 and over shoulders 27 and extensions 26. Then, hold down bars 32 are pivoted downwardly, as aforementioned, in order to hold the piece of material 36 in position.

With such an arrangement, the piece of material 36 can be used for mopping up spills, drying wet floors, dusting and/or sweeping. After use, hold down bars 32 are pivoted upwardly, and the piece of material 36 is removed, and either discarded or washed with a normal wash. As a result, it is not necessary to provide any wringing out of the sponge material, except during very heavy absorption of liquid. At the same time, the mop can be used for dusting and/or sweeping, and cleaning up of the same is relatively easy and simple. Further, the mop can be used as a conventional mop if the piece of material 36 is not used, as shown in FIG. 3.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A mop comprising:

a handle; and a mop head pivotally secured to one end of said handle, said mop head including:

a main body having a generally rectangular parallelepiped configuration with a lower surface and first and second shoulders on opposite sides of said mop head which are formed by extensions secured to opposite sides of said main body, each said shoulder forming a corner, a foam pad secured to a lower surface of said main body, first and second hold down bars movably arranged on said main body, said hold down bars releasably engaging and holding down a deformable, absorbent piece of material which is wrapped about said foam pad by engaging ends of said piece of material on said first and second shoulders, said first and second hold down bars pivotally connected to said main body between a raised position above an upper surface of said main body and at which said piece of material is not held down thereby, and a lower locking position at which the ends of said piece of material are held down on said first and second shoulders, and a releasable lock down assembly which releasably holds said first and second hold down bars on said first and second shoulders, respectively, said lock down assembly including at least one protrusion which extends outwardly from each side of said main body such that said first and second hold down bars are releasably held by said protrusions so as to be wedged at the corners of said first and second shoulders by said at least one protrusion, with said piece of material extending over said at least one protrusion.

2. A mop according to claim 1, wherein said extensions are integrally formed with said main body.

3. A mop according to claim 1, wherein each extension has a lower surface which is parallel and coplanar with the lower surface of the main body.

4. A mop according to claim 1, wherein each hold down bar has a U-shape with opposite ends having inturned portions, and said main body includes opposite ends with holes for receiving said inturned portions so as to pivotally secure said first and second hold down bars to said main body.

5. A mop according to claim 1, further including a handle securing assembly which pivotally mounts a lower end of said handle to said main body.

6. A mop according to claim 5, wherein said handle securing assembly includes two plates extending upwardly from the upper surface of said main body and which receives the one end of said handle therein, and a bolt extending through said plates and the one end of said handle so as to pivotally secure the one end of the handle to the main body.

* * * * *